US010947648B2

(12) United States Patent
Hozumi et al.

(10) Patent No.: US 10,947,648 B2
(45) Date of Patent: Mar. 16, 2021

(54) WOVEN GAUZE FABRIC

(71) Applicant: UCHINO CO., LTD., Chuo-ku (JP)

(72) Inventors: Shuichi Hozumi, Chuo-ku (JP); Hisashi Ito, Chuo-ku (JP)

(73) Assignee: UCHINO CO., LTD, Tokyo (JP)

( * ) Notice: Subject to any disclaimer, the term of this patent is extended or adjusted under 35 U.S.C. 154(b) by 0 days.

(21) Appl. No.: 15/037,268

(22) PCT Filed: Jun. 20, 2014

(86) PCT No.: PCT/JP2014/066469

§ 371 (c)(1),
(2) Date: May 17, 2016

(87) PCT Pub. No.: WO2015/194046

PCT Pub. Date: Dec. 23, 2015

(65) Prior Publication Data

US 2016/0289870 A1 Oct. 6, 2016

(51) Int. Cl.
*D03D 19/00* (2006.01)
*D03D 11/00* (2006.01)
(Continued)

(52) U.S. Cl.
CPC ..... *D03D 19/00* (2013.01); *D03D 9/00* (2013.01); *D03D 11/00* (2013.01); *D03D 15/44* (2021.01);
(Continued)

(58) Field of Classification Search
CPC ..... D03D 19/00; D03D 5/0083; D03D 9/00; D03D 11/00; D03D 2700/0111; D10B 2503/06; D10B 2501/00
See application file for complete search history.

(56) References Cited

U.S. PATENT DOCUMENTS 3,747,601 A * 7/1973 May, Jr. ..... A61F 13/49003 604/377
4,479,270 A * 10/1984 Novinger ..... A41D 31/0033 2/69
(Continued)

FOREIGN PATENT DOCUMENTS

CN 2622213 Y 6/2004
CN 1675421 A 9/2005
(Continued)

OTHER PUBLICATIONS

International Search Report dated Aug. 19, 2014, in PCT/JP2014/066469 Filed Jun. 20, 2014.
(Continued)

*Primary Examiner* — Elizabeth C Imani
(74) *Attorney, Agent, or Firm* — Masuvalley & Partners

(57) ABSTRACT

A woven gauze fabric excellent in balance between breathability and heat-retaining property, transparency preventing property, and good touch feeling (softness). The woven gauze fabric includes a surface layer $G_1$ and a back layer $G_3$, wherein the layer $G_1$ and $G_3$ are directly and/or indirectly joined together. The layer $G_1$ is formed of a hollow yarn having a yarn count of 30-50 (both inclusive), and the layer $G_3$ is formed of a hollow yarn having a yarn count of 30-50 (both inclusive). In a case where the woven gauze fabric is a triple gauze including a middle layer $G_2$, the hollow yarn of the layer $G_1$ and $G_3$ have a yarn count of 40-50 (both inclusive). In a case where the woven gauze fabric is a double gauze, the hollow yarn of the layer $G_1$ and $G_3$ have a yarn count of 30-40 (both inclusive).

15 Claims, 5 Drawing Sheets

(51) Int. Cl.
*D03D 9/00* (2006.01)
*D03D 15/44* (2021.01)

(52) U.S. Cl.
CPC .. *D03D 2700/0111* (2013.01); *D10B 2501/00* (2013.01); *D10B 2503/06* (2013.01)

(56) References Cited

U.S. PATENT DOCUMENTS

| | | | | | |
|---|---|---|---|---|---|
| 5,997,980 | A | * | 12/1999 | Matoba | D01D 5/24 428/376 |
| 6,207,597 | B1 | | 3/2001 | Ogita et al. | |
| 6,432,504 | B1 | * | 8/2002 | Yeh | B32B 5/26 428/85 |

FOREIGN PATENT DOCUMENTS

| | | | | |
|---|---|---|---|---|
| CN | 101012585 | A | * | 8/2007 |
| CN | 201529069 | U | | 7/2010 |
| CN | 101932761 | A | | 12/2010 |
| CN | 202011931 | U | | 10/2011 |
| CN | 102433639 | A | | 5/2012 |
| CN | 202359282 | U | | 8/2012 |
| EP | e | | | 10/2002 |
| JP | 6-93531 | A | | 4/1994 |
| JP | 9-31781 | A | | 2/1997 |
| JP | 9-95836 | A | | 4/1997 |
| JP | 11-323693 | A | | 11/1999 |
| JP | 2000-226745 | A | | 8/2000 |
| JP | 2002-155183 | A | | 5/2002 |
| JP | 2003-301347 | A | | 10/2003 |
| JP | 2004-107823 | A | | 4/2004 |
| JP | 2004-107824 | A | | 4/2004 |
| JP | 2007-303008 | A | | 11/2007 |
| JP | 2011-63896 | A | | 3/2011 |
| JP | 3187096 | U | | 11/2013 |
| JP | 3187096 | U | * | 11/2013 |
| JP | 5435607 | B1 | | 12/2013 |
| JP | 3189066 | U | | 2/2014 |
| JP | 5435607 | B1 | | 3/2014 |
| JP | 2014-65977 | A | | 4/2014 |

OTHER PUBLICATIONS

Combined Office Action and Search Report dated Sep. 26, 2016 in Chinese Patent Application No. 201480049789.8 (with partial English translation and English translation of Categories of Cited Documents).

Combined Taiwanese Office Action and Search Report dated May 10, 2016 in Patent Application No. 104118085 (with English translation of categories of cited documents).

Combined Office Action and Search Report dated Aug. 14, 2017 in Chinese Patent Application No. 201480049789.8 (with partial English language translation and translation of categories of cited documents).

Extended European Search Report dated Mar. 2, 2018 in Patent Application No. 14894910.0.

* cited by examiner present embodiment
double woven gauze
hollow yarn having a yarn count of 30 comparison example
double woven gauze
ordinary yarn having a yarn count of 40

WOVEN GAUZE FABRIC

This application is a 371 or PCT JP2014/066469 filed Jun. 20, 2014.

TECHNICAL FIELD

The present invention relates to a woven gauze fabric.

BACKGROUND ART

A woven gauze fabric is a coarse-meshed flat woven fabric that s woven by using a relatively fine yarn. The woven gauze fabric includes a single woven fabric, a double woven fabric, a triple woven fabric, and so on. The single woven fabric is used for medical application, dishcloth, etc. The double woven fabric is used for clothes, handkerchief, etc. A cotton yarn (a single yarn having a yarn count of 40) is used for it. The triple woven gauze fabric is used for towels, bedding, etc. A cotton yarn (a single yarn having a yarn count of 50-60) is used for it. In a configuration of the single woven fabric, normally, the sum of the number of weft yarns and warp yarns per inch is a density of 50-120 yarns. Density of less than 50 yarns cannot form a gauze fabric. High density beyond 120 yarns is not normally referred to as a gauze fabric.

CITATION LIST

Patent Literature

[PATENT LITERATURE 1]
JP 1999-323693A
[PATENT LITERATURE 2]
JP 2004-107823A
[PATENT LITERATURE 3]
JP 2004-107024A
[PATENT LITERATURE 4]
JP 2007-303008A
[PATENT LITERATURE 5]
JP Utility Model Registration No. 3187096

SUMMARY OF INVENTION

Technical Problem

The inventor of the present application studied about application of a woven gauze fabric to cloth for clothes and bedding. As a result thereof, the inventor determined that, for the reasons as will be described below, various functions (e.g., heat-retaining property, transparency preventing property, softness) of the conventional woven gauze fabric are not enough for the woven gauze fabric to be applied to the cloth for clothes and bedding and, thus, there is room for improvement on these functions.

A gauze fabric is a coarse-meshed fabric (has a wide gap between yarns). Because the gauze fabric is a flat woven fabric that is woven loosely, the gauze fabric has excellent breathability. However, the gauze fabric is poor in heat-retaining property. Even if the gauze fabric is formed into a multiple gauze fabric, the multiple gauze fabric is still thin. Therefore, a good heat-retaining property cannot be expected.

A gauze fabric is a coarse-meshed fabric (has a wide gap between yarns). Therefore, if the woven gauze fabric is used as, for example, clothes, skin is seen through the gauze fabric. To solve the problem, the gauze fabric is colored deeply to compensate a shortage of transparency preventing property. This reduces a degree of freedom of color selection of clothes from consumers.

Meanwhile, if a gauze fabric is formed of a yarn having a thicker count or s woven more densely, the transparency preventing property improves but breathability and lightness that are characteristics of gauze fabric is remarkably deteriorated.

A gauze fabric is a coarse-meshed fabric (has a wide gap between yarns). Therefore, the gauze fabric is poor in bounce and softness.

In view of the above, the present invention was made to solve the above problems. A purpose of the present invention is to provide a woven gauze fabric excellent in balance between breathability and heat-retaining property, transparency preventing property, and good touch feeling (softness).

Solution to Problem

The invention that solves the above described problem is directed to a woven gauze fabric including a surface layer and a back layer, wherein the surface layer and the back layer are indirectly joined together.

The surface layer is formed of warp yarns and weft yarns which are composed of a hollow yarn having a yarn count of 30-50 (both inclusive). The back layer is formed of warp yarns and weft yarns which are composed of a hollow yarn having a yarn count of 30-50 (both inclusive).

Use of the hollow yarn allows a thicker yarn, that is hollow, to be employed for the woven gauze fabric if weights are the same. This contributes to enhancement of heat-retaining property and transparency preventing property. Further, use of the hollow yarn improves softness of the woven gauze fabric.

In the above described invention, it is preferable that at least one middle layer is interposed between the surface layer and the back layer, the middle layer is formed of warp yarns and weft yarns. In other words, the woven gauze fabric is a multiple woven gauze fabric that is composed of more than three layers. Each of a hollow yarn of the surface layer and a hollow yarn of the back layer has a yarn count of 40-50 (both inclusive). Wherein surfaces of the layers are separated and substantially spaced apart from each other, and wherein the surface layer and the back layer are indirectly joined together comprising that at least one warp yarn of the middle layer entwines at least one weft yarn of the surface layer, and at least one warp yarn of the middle layer entwines at least one weft yarn of the back layer, each layer is configured to move slightly between each other.

In the above described invention, it is more preferable that the at least one middle layer of a plurality of middle layers is formed of an ordinary yarn (non-hollow yarn) having a fine count thinner than the hollow yarn forming the surface layer and the hollow yarn forming, the back layer.

In the above described invention, it is more preferable that at least one middle layer of the plurality of middle layers is formed of a double yarn.

In the above described invention, it is preferable that the woven gauze fabric is a double woven gauze fabric including the surface layer and the back layer. Each of the hollow yarn of the surface layer and the hollow yarn of the back layer has a yarn count of 30-40 (both inclusive).

The present invention that solves the above described problem is directed to the woven gauze fabric, more specifically, a woven gauze fabric for garment.

The present invention that solves the above described problem s directed to clothes formed of the woven gauze fabric.

The present invention that solves the above described problem is directed to bedding formed of the woven gauze fabric.

Advantageous Effect of Invention

The woven gauze fabric of the present invention is excellent in balance between breathability and heat-retaining property, as compared to the conventional woven gauze fabric, if both have about the same weight.

The woven gauze fabric of the present invention is excellent in transparency preventing property, as compared to the conventional woven gauze fabric, if both have about the same weight.

The woven gauze fabric of the present invention is excellent in a good touch feeling (softness), as compared to the conventional woven gauze fabric, if both have about the same weight.

The woven gauze fabric of the present invention is excellent in the above described performances at a level enough to be applied to clothes and bedding.

DESCRIPTION OF EMBODIMENTS

First Embodiment

~Summary~

Figure 1:
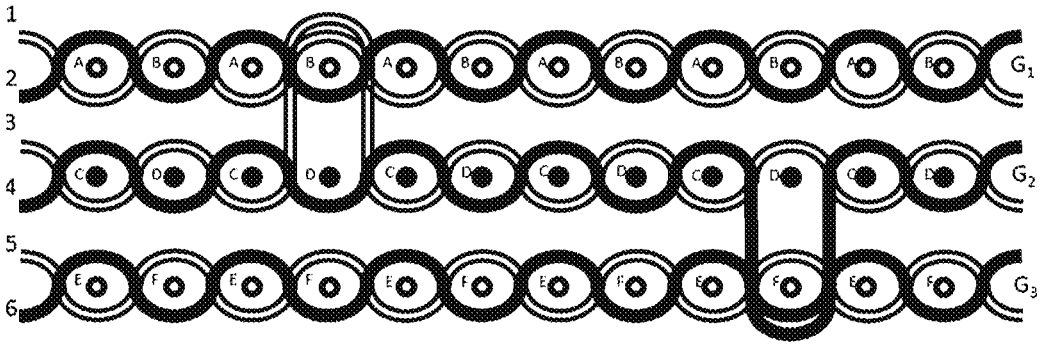
FIG. 1 is a cross sectional view of a woven gauze fabric according to a first embodiment of the present invention.

FIG. 1 is a cross sectional view of a multiple woven gauze fabric according to a first embodiment of the present invention. The present invention is an N-layered (N is an integer equal to or greater than 3) woven gauze fabric. A triple woven gauze fabric will be exemplified below for the sake of easy understanding of the present invention.

The woven gauze fabric includes a surface layer $G_1$, a middle layer $G_2$, and a back layer $G_3$.

The surface layer $G_1$ is formed of warp yarns (lengthwise yarns) 1,2 and weft yarns (crosswise yarns) A, B. Both of the warp yarns 1,2 and the weft yarns A, B are hollow yarns having a yarn count of 40-50 (both inclusive).

The middle layer $G_2$ is formed of warp yarns 3, 4 and weft yarns C, D. Both of the warp yarns 3, 4 and the weft yarns C, D are ordinary yarns (single yarns) having a yarn count of 50-60 (both inclusive) or ordinary yarns (double yarns) having a yarn count of 100-120 (both inclusive).

The back layer $G_3$ is formed of warp yarns 5, 6 and weft yarns E, F. Both of the warp yarns 5, 6 and the weft yarns E, F are hollow yarns having a yarn count of 40-50 (both inclusive).

In the triple woven gauze fabric composed of the surface layer $G_1$, the middle layer $G_2$, and the back layer $G_3$, the layers being laminated together, the warp yarn 3 (or the warp yarn 4) entwines the weft yarn B (or the weft yarn A) at a proper position (area) (see, FIG. 1). In other words, a twisted yarn (warp yarn) 3 of the middle layer $G_2$ serves to join the middle layer $G_2$ and the surface layer $G_1$.

In the triple woven gauze fabric composed of the surface layer $G_1$, the middle layer $G_2$, and the back layer $G_3$, the layers being laminated together, the warp yarn 4 (or the warp yarn 3) entwines the weft yarn F (or the weft yarn E) at a proper position (area) (see, FIG. 1). In other words, a twisted yarn (warp yarn) 4 of the middle layer serves to join the middle layer $G_2$ and the surface layer $G_1$.

In the woven gauze fabric of the present embodiment, constructions are joined together via warp yarns (vertical yarns).

~Modification~

Figure 2:
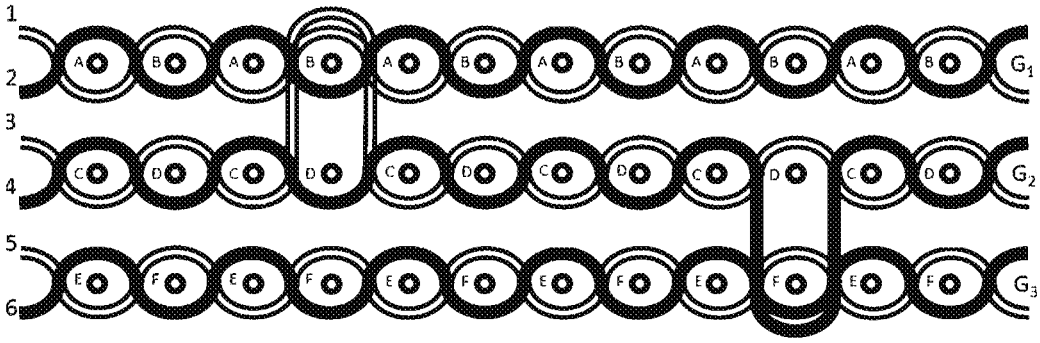
FIG. 2 is a cross sectional view of a modification according to the first embodiment of the present invention.

FIG. 2 is a modification. The middle layer $G_2$ is composed of warp yarns 3, 4 and weft yarns C, D. Both of the warp yarns 3, 4 and the weft yarns C, D are hollow yarns having a yarn count of 40-50 (both inclusive). The other structures of the modification are common to those of the first embodiment. More specifically, the modification employs a triple woven gauze fabric formed of hollow yarns.

Alternatively, constructions may be joined together via weft yarns (lateral yarns). Further alternatively, constructions may be joined together by using both of the warp yarns and the weft yarns. Still further alternatively, the constructions may be joined together such that the surface layer $G_1$ and the back layer $G_3$ may be directly joined together, which allows the middle layer between the surface layer $G_1$ and the back layer $G_3$ to be joined together with the surface layer $G_1$ and the back layer $G_3$ indirectly.

~Difference from Comparison Example and Effects Thereof~

Figure 3:
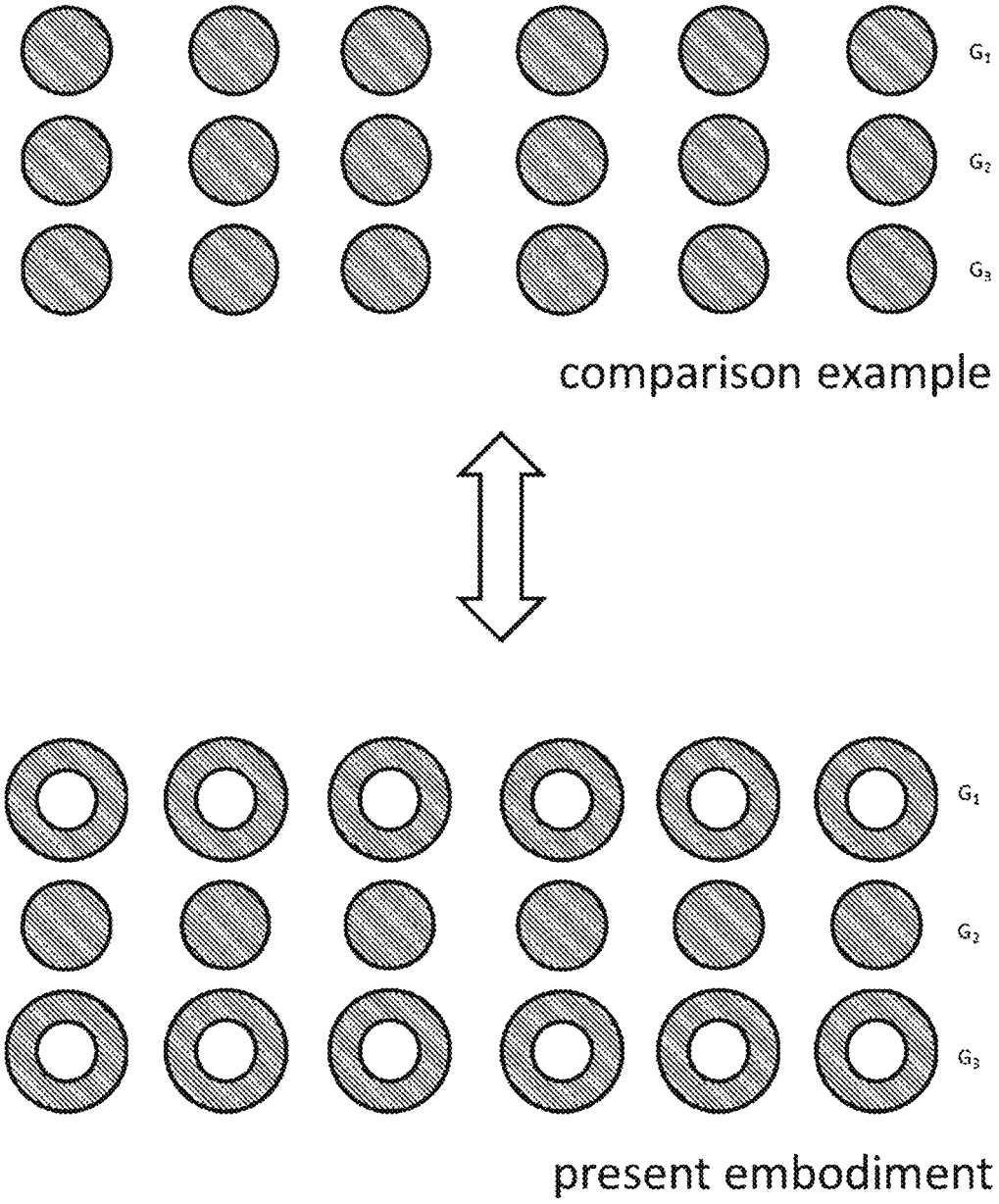
FIG. 3 is a conceptual diagram illustrating a difference between a triple woven gauze fabric according to the first embodiment and a triple woven gauze fabric of a comparison example.

FIG. 3 is a conceptual diagram illustrating a difference between the triple woven gauze fabric according to the first embodiment and a triple woven gauze fabric of a comparison example.

Table 1 shows a difference between a structure of a comparison example 1 and structures of the example 1-1 to the example 1-5 of the present embodiment. Weight (g) of yarn per a length of100 m is also shown in Table 1. Further, the sum of the three layers is utilized as an index of weight.

TABLE 1

| | comparison example 1 | weight (g) per 100 m |
|---|---|---|
| G1 | yarn court of 50 ordinary yarn (single) | 1.18 |

TABLE 1-continued

| | | |
|---|---|---|
| G2 | yarn count of 50 ordinary yarn (single) | 1.18 |
| G3 | yarn count of 50 ordinary yarn (single) | 1.18 |
| sum of the three layers | | 3.54 |

↓↑ first embodiment

| | example 1-1 | weight (g) per 100 m | | example 1-2 | weight (g) per 100 m | | example 1-3 | weight (g) per 100 m |
|---|---|---|---|---|---|---|---|---|
| G1 | yarn count of 40 hollow yarn | 1.18 | G1 | yarn count of 40 hollow yarn | 1.18 | G1 | yarn count of 40 hollow yarn | 1.18 |
| G2 | yarn count of 50 ordinary yarn (single) | 1.18 | G2 | yarn count of 40 hollow yarn | 1.18 | G2 | yarn count of 100 ordinary yarn (double) | 1.18 |
| G3 | yarn count of 40 hollow yarn | 1.18 | G3 | yarn count of 40 hollow yarn | 1.18 | G3 | yarn count of 40 hollow yarn | 1.18 |
| sum of the three layers | | 3.54 | sum of the three layers | | 3.54 | sum of the three layers | | 3.54 |

| | | | | | | | | |
|---|---|---|---|---|---|---|---|---|
| | | | | example 1-4 | weight (g) per 100 m | | example 1-5 | weight (g) per 100 m |
| | | | G1 | yarn count of 40 hollow yarn | 1.18 | G1 | yarn count of 40 hollow yarn | 1.18 |
| | | | G2 | yarn count of 60 ordinary yarn (single) | 0.98 | G2 | yarn count of 120 ordinary yarn (double) | 0.98 |
| | | | G3 | yarn count of 40 hollow yarn | 1.18 | G3 | yarn count of 40 hollow yarn | 1.18 |
| | | | sum of the three layers | | 3.34 | sum of the three layers | | 3.34 |

The comparison example 1 is a triple woven gauze fabric wherein three layers of gauze fabrics are laminated together, each layer being formed of an ordinary yarn (non-hollow yarn) having a yarn count of 50. An index of weight is 3.54 g.

In the example 1-1, the surface layer $G_1$ is formed of a hollow yarn having a yarn count of 40, the middle layer $G_2$ is formed of an ordinary yarn having a yarn count of 50, and the back layer $G_3$ is formed of a hollow yarn having a yarn count of 40. Weight per 100 m of an ordinary yarn having a yarn count of 40 is 1.48 g, whereas weight of hollow yarn having a yarn count of 40 is 1.18 g. In other words, weight per 100 m of hollow yarn is 20% less than that of ordinary yarn. An index of weight is 3.54 g.

Example 1-2 is a triple woven gauze fabric wherein three layers of gauze fabrics are laminated together, each layer being formed of hollow yarns having a yarn count of 40. Namely, a structure of the middle layer $G_2$ is different from that of the example 1-1. An index of weight is 3.54 g.

In example 1-3, the surface layer $G_1$ is formed of a hollow yarn having a yarn count of 40, the middle layer $G_2$ is formed of an ordinary yarn (double yarn) having a yarn count of 100, and the back layer $G_3$ is formed of a hollow yarn having a yarn count of 40. Namely, a structure of the middle layer $G_2$ is different from that of the example 1-1. An index of weight is 3.54 g.

In other words, the example 1-1 to the example 1-3 are in common with each other in the following points: The woven gauze fabrics have almost the same weight as the woven gauze fabric of the comparison example 1; and the surface layers $G_1$ and the back layers $G_3$ are formed of a hollow yarn having a yarn count of 40. The example 1-1 to the example 1-3 differs from one another in the following point: Structures of the middle layers $G_2$ are different from one another.

By making a comparison between the comparison example 1 and the example 1-1 to the example 1-3, effects of the present embodiment will be studied below.

The comparison starts between the comparison example 1 and the example 1-1. The surface layer $G_1$ and the back layer $G_3$ are formed of an ordinary yarn (non-hollow yarn) having a yarn count of 50 in the comparison example 1, whereas the surface layer $G_1$ and the back layer $G_3$ are formed of a hollow yarn having a yarn count of 40 in the example 1-1.

With the use of a yarn having a yarn count of 40 that is thicker than a yarn count of 50 (the former has about 11% larger diameter than the latter), bulkiness appears in the woven gauze fabric of the example 1-1. As a result thereof, more air can be retained, and heat-retaining property improves. Further, a hollow yarn itself retains air therein. This also contributes to enhancement of heat-retaining property.

A yarn having a yarn count of 40 is thicker than a yarn having a yarn count of 50. Therefore, if the comparison example 1 and the example 1-1 have the same density of yarns, the example 1-1 has a narrower gap between yarns. Further, cloth of the example 1-1 is thicker than that of the comparison example 1. As a result, transparency preventing property improves. Specifically, in the triple woven gauze fabric, a slight movement of each layer suppresses transparency. Therefore, the triple woven gauze fabric shows notable transparency preventing effect.

The woven gauze fabric of the comparison example 1 tends to be transparent, and thus is darkly colored, when it is used for clothes, to compensate a shortage of transparency preventing property. To the contrary, in the example 1-1, freedom of color selection can be obtained according to the enhancement of the transparency preventing property.

A hollow yarn having a yarn count of 40 and an ordinary yarn (non-hollow yarn) having a yarn count of 50 are about the same weight. This allows the resulting woven gauze fabrics to have about the same weight each other.

Further, a hollow yarn is excellent in flexibility and pliability, as compared to an ordinary yarn. This produces an effect of soft touch feeling. Further, a hollow yarn is excellent in water absorbency property and drying property. Still further, since a yarn having a yarn count of 40 is thicker than a yarn having a yarn count of 50, a contact area that contacts skin increases to give consumers a soft touch feeling.

Then, easy sewing property will be described below. As a density of cloth becomes higher and a gap becomes smaller, a contact area between a sewing thread and cloth increases and a frictional resistance force becomes large. This contributes to improvement of retention by a sewing thread. As cloth becomes thicker, a contact area between a sewing thread and the cloth increases, resulting in that a frictional resistance force becomes larger. This contributes to enhancement of retention by the sewing thread. The enhancement of retention by the sewing thread can invite movement of sewing strength. The high sewing strength can expand selection range of sewing method, resulting in achieving obtainment of strength with simpler sewing.

As the cloth becomes thicker in the example 1-1, sewing becomes easier, as compared to the comparison example 1.

However, since a gap between yarns was narrower in the example 1-1 than that of the comparison example 1, degradation of breathability was concerned. However, as a result of performance test, the degradation of breathability was at a level that can be ignored. Since a woven gauze fabric naturally has notable breathability, the woven gauze fabric is not hardly influenced by the degradation of breathability. In other words, the example 1-1 has breathability equivalent to that of the comparison example 1.

As described above, the woven gauze fabric of the example 1-1 is excellent in balance between breathability and heat-retaining property, transparency preventing property, good touch feeling (softness), and easy sewing, as compared to the woven gauze fabric of the comparison example 1 that has about the same weight as weight of the woven gauze fabric of the example 1-1.

Now, the example 1-2 and the example 1-3 will be studied below. Since both of the example 1-2 and the example 1-3 have structures common to the structure of the example 1-1, a similar effect can be produced.

On the other hand, the middle layer $G_2$ is formed of an ordinary yarn (non-hollow yarn) having a yarn count of 50 in the example 1-1, whereas the middle layer $G_2$ is formed of a hollow yarn having a yarn count of 40 in the example 1-2. This renders a concern of slight degradation of breathability in the example 1-2, while heat-retaining property, transparency preventing property, good touch feeling (softness), and easy sewing are more enhanced in the example 1-2 than those of the example 1-1.

Meanwhile, if strength of cloth is not enough, the cloth may be torn while it is sewn. The middle layer $G_2$ is formed of an ordinary yarn (single yarn) having a yarn count of 50 in the example 1-1, whereas the middle layer $G_2$ is formed of an ordinary yarn (double yarn) having a yarn count of 100 in the example 1-3. A double yarn having a yarn count of 100, if weight thereof is about the same as a single yarn having a yarn count of 50, has strength equivalent to a single yarn having a yarn count of 40. Accordingly, easy sewing improves more owing to the enhancement of strength of the cloth in the example 1-3, while the example 1-3 maintains heat-retaining property, breathability, transparency preventing property, and good touch feeling (softness) of the example 1-1.

Further, the example 1-4 and the example 1-5 will be studied below. Since both of the example 1-4 and the example 1-5 have structures common to that of the example 1-1, corresponding effects can be obtained.

The middle layer $G_2$ is formed of an ordinary yarn (non-hollow yarn) having a yarn count of 50 in the example 1-1, whereas the middle layer $G_2$ formed of an ordinary yarn having a yarn count of 60 in the example 1-4, and the middle layer $G_2$ is formed of an ordinary yarn (double yarn) having a yarn count of 120 in the example 1-5. Therefore, it is possible to achieve further lightness in the example 1-4 and the example 1-5, as compared to the example 1-1 (or comparison example 1). Further, the breathability of the woven gauze fabrics of the example 1-4 and the example 1-5 improves more, as compared to the fabric of the example 1-1.

A double yarn having a yarn count of 120 has strength equivalent to a single yarn having a yarn count of 50, if the double yarn having a yarn count of 120 has weight about the same as weight of a single yarn having a yarn count of 60. Owing to the enhancement of the cloth strength, easy sewing improves more.

Table 2 illustrates a difference between a structure of the comparison example 2 and structures of the example 2-1 to the example 2-3 of the present embodiment. Weight (g) per yarn of 100 m is also shown in Table 2. The sum of weight of the three layers is used as an index of weight.

TABLE 2

| | comparison example 2 | weight (g) per 100 m |
|---|---|---|
| G1 | yarn court of 50 ordinary yarn (single) | 0.98 |
| G2 | yarn count of 60 ordinary yarn (single) | 0.98 |
| G3 | yarn count of 60 ordinary yarn (single) | 0.98 |
| | sum of the three layers | 2.94 |

↓↑ first embodiment

| | example 2-1 | weight (g) per 100 m | | example 2-2 | weight (g) per 100 m | | example 2-3 | weight (g) per 100 m |
|---|---|---|---|---|---|---|---|---|
| G1 | yarn court of 50 hollow yarn | 0.94 | G1 | yarn court of 50 hollow yarn | 0.94 | G1 | yarn court of 50 hollow yarn | 0.94 |
| G2 | yarn count of 60 ordinary yarn (single) | 0.98 | G2 | yarn count of 50 hollow yarn | 0.94 | G2 | yarn count of 120 ordinary yarn (double) | 0.96 |

TABLE 2-continued

| | | | | | | | | |
|---|---|---|---|---|---|---|---|---|
| G3 | yarn count of 50 hollow yarn | 0.94 | G3 | yarn count of 50 hollow yarn | 0.94 | G3 | yarn count of 50 hollow yarn | 0.94 |
| sum of the three layers | | 2.86 | sum of the three layers | | 2.82 | sum of the three layers | | 2.84 |

A comparison example 2 is a triple woven gauze fabric that is composed of three layers of gauze fabrics, the layers being laminated together and formed of an ordinary yarn having a yarn count of 60. An index of weight is 2.94 g.

In the example 2-1, the surface layer $G_1$ is formed of a hollow yarn having a yarn count of 50, the middle layer $G_2$ is formed of an ordinary yarn (non-hollow yarn) having a yarn count of 60, and the back layer $G_3$ is formed of a hollow yarn having a yarn count of 50. Weight of the ordinary yarn, having a yarn count of 50, per 100 m is 1.18 g, whereas weight of the hollow yarn, having a yarn count of 50, per 100 m is 0.94 g. In other words, the weight of a hollow yarn is reduced by 20% of the weight of the ordinary yarn. An index of weight is 2.86 g.

The example 2-2 is a triple woven gauze fabric composed of three layers of gauze fabrics, the layers being formed of a hollow yarn having a yarn count of 50. In other words, the example 2-2 differs from the example 2-1 in a structure of the middle layer $G_2$, An index of weight is 2.82 g.

In the example 2-3, the surface layer $G_1$ is formed of a hollow yarn having a yarn count of 50, the middle layer $G_2$ is formed of an ordinary yarn (double yarn) having a yarn count of 120, and the back layer $G_3$ is formed of a hollow layer having a yarn count of 50. More specifically, the structure of the middle layer $G_2$ differs from that of the example 2-1. An index of weight is 2.84 g.

In other words, the example 2-1 to the example 2-3 have such a common points that the fabrics thereof have the same or slightly lighter weight as/than the fabric of the comparison example 2, and the surface layer $G_1$ and the back layer $G_3$ are formed of a hollow yarn having a yarn count of 50, but are different from one another n a structure of the middle layer $G_2$.

A comparison is made between the comparison example 2 and the example 2-1 to the example 2-3 to study effects of the present embodiment below.

Initially, the comparison example 2 is compared to the example 2-1. The surface layer $G_1$ and the back layer $G_3$ are formed of an ordinary yarn (non-hollow yarn) having a yarn count of 60 in the comparison example 2, whereas the surface layer $G_1$ and the back layer $G_3$ are formed of a hollow yarn having a yarn count of 50 in the example 2-1.

Since a yarn having a yarn count of 50 is thicker than a yarn having a yarn count of 60 (the former has about 10% larger diameter than the latter), the fabric of the example 2-1 comes to show better bulkiness. As a result, more air can be retained and thus heat-retaining property improves in the fabric of the example 2-1. Further, a hollow yarn retains air in its inside. This also improves heat-retaining property of the fabric of the example 2-1.

A yarn having a yarn count of 50 is thicker than a yarn having a yarn count of 60. If both of the fabrics of the comparison example 2 and the example 2-1 have the same yarn density, the fabric of the example 2-1 has a narrower gap between yarns. Further, the cloth of the example 2-1 is thicker than that of the comparison example 2. As a result thereof, transparency preventing property improves. Specifically, in the triple woven gauze fabric, each layer slightly moves to hinder transparency of the fabric, i.e., to produce notable transparency preventing property.

In some cases, it is difficult to apply the fabric of the comparison example 2 to clothes due to transparency of the fabric. However, in the example 2-1, enhancement of the transparency preventing property improves applicability of the fabric to clothes.

A hollow yarn having a yarn count of 50 has weight equivalent to or slightly lighter than an ordinary yarn having a yarn count of 60. This makes weight of the fabric of the example 2-1 be equalized to or be lighter than weight of the fabric of the comparison example 2.

Further, a hollow yarn is more excellent in flexibility and pliability than those of an ordinary yarn. This produces a soft touch feeling. Further, a hollow yarn is excellent in water absorbency property and drying property. Still further, since a yarn having a yarn count of 50 is thicker than a yarn having a yarn count of 60, a contact area that contacts skin increases to produce a soft touch feeling.

As the fabric becomes thicker in the example 2-1, sewing can be performed easier, as compared to the comparison example 2.

Since a gap between yarns was narrower in the example 2-1 than that of the comparison example 2, there was a concern about breathability. However, as a result of a performance test, degradation of breathability was at a level that was ignorable. Since a woven gauze fabric naturally has notable breathability, the woven gauze fabric is hardly influenced by the degradation of breathability. More specifically, the fabric of the example 2-1 has breathability equivalent to the fabric of the comparison example 2.

As described above, the fabric of the example 2-1 is excellent in balance between breathability and heat-retaining property, transparency preventing property, good touch feeling (softness), and easy sewing property, as compared to the fabric of the comparison example 2, if both have about the same weight.

Next, the example 2-2 and the example 2-3 will be studied below. Since both of n the fabrics of the example 2-2 and the example 2-3 have structures common to a structure of the fabric of the example 2-1, similar effects can be produced.

On the other hand, the middle layer $G_2$ is formed of an ordinary yarn (non-hollow yarn) having a yarn count of 60 in the example 2-1, whereas the middle layer $G_2$ is formed of a hollow yarn having a yarn count of 50 in the example 2-2. This contributes to more enhancement of heat-retaining property, transparency preventing property, good touch feeling (softness), and easy sewing, property, however, raises a concern about more degradation of breathability in the fabric of the example 2-2, as compared to the fabric of the example 2-1.

Further, the middle layer $G_2$ is formed of an ordinary yarn (single yarn) having a yarn count of 60 in the example 2-1, whereas the middle layer $G_2$ is formed of an ordinary yarn (double yarn) having a yarn count of 120 in the example 2-3. A double yarn having a yarn count of 120, if it has the same weight as that of a single yarn having a yarn count of 60, has strength equivalent to a single yarn having a yarn count of 50. This allows the example 2-3 to maintain heat-retaining property, breathability, transparency preventing property, and good touch feeling (softness) of the example 2-1. In addition, easy sewing property is further improved in the example 2-3 owing to the enhanced strength.

The surface layer $G_1$ and the back layer $G_3$ are formed of a hollow yarn having a yarn count of 40 in the example 1-1 to the example 1-5, whereas the surface layer $G_1$ and the back layer $G_3$ are formed of a hollow yarn having a yarn count of 50 in the example 2-1 to the example 2-3. Meanwhile, it is difficult by the current art to spin a hollow yarn that has a fine count thinner than a yarn count of 50.

Meanwhile, when a comparison is made between the comparison example 1 and the example 2-1 to the example 2-3, the fabrics of the example 2-1 to the example 2-3 have bulkiness equivalent to that of the comparison example 1 and thus can produce similar effects as those of the comparison example 1. Further, the fabrics of the example 2-1 to the example 2-3 can achieve more enhanced lightness than that of the comparison example 1.

Second Embodiment

~Summary~

Figure 4:
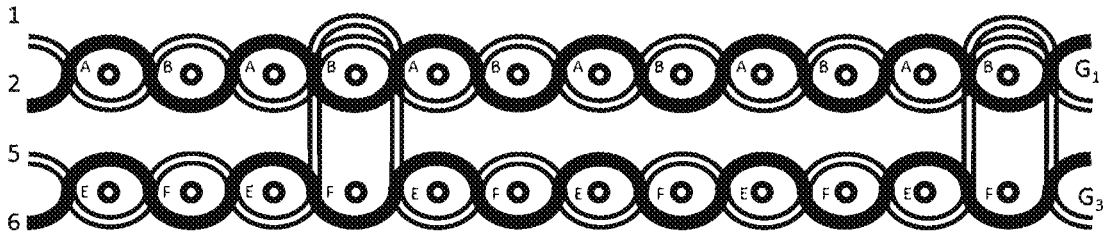
FIG. 4 is a cross sectional view of a woven gauze fabric according to a second embodiment of the present invention.

FIG. 4 is a cross sectional view of a multiple woven gauze fabric according to a second embodiment of the present invention. The multiple (triple) woven gauze fabric is exemplified in the first embodiment, whereas a double woven gauze fabric is exemplified in the second embodiment.

The woven gauze fabric includes the surface layer $G_1$ and the back layer $G_3$.

The surface layer $G_1$ is formed of warp yarns (lengthwise yarns) 1,2 and weft yarns (crosswise yarns) A, B. Both of the warp yarns 1,2 and the weft yarns A, B are hollow yarns having a yarn count of 30-40 (both inclusive).

The back layer $G_3$ is formed of warp yarns 5, 6 and weft yarns E, F. Both of the warp yarns 5, 6 and the weft yarns E, F are formed of hollow yarns having a yarn count of 30-40 (both inclusive).

In a double woven gauze fabric composed of the surface layer $G_1$ and the back layer $G_3$ that are laminated together, configurations of the surface layer $G_1$ and the back layer $G_3$ are joined each other by the warp yarns (lengthwise yarns) or/and the weft yarns (crosswise yarns).

~Difference from Comparison Example and Effects Thereof~

Figure 5:
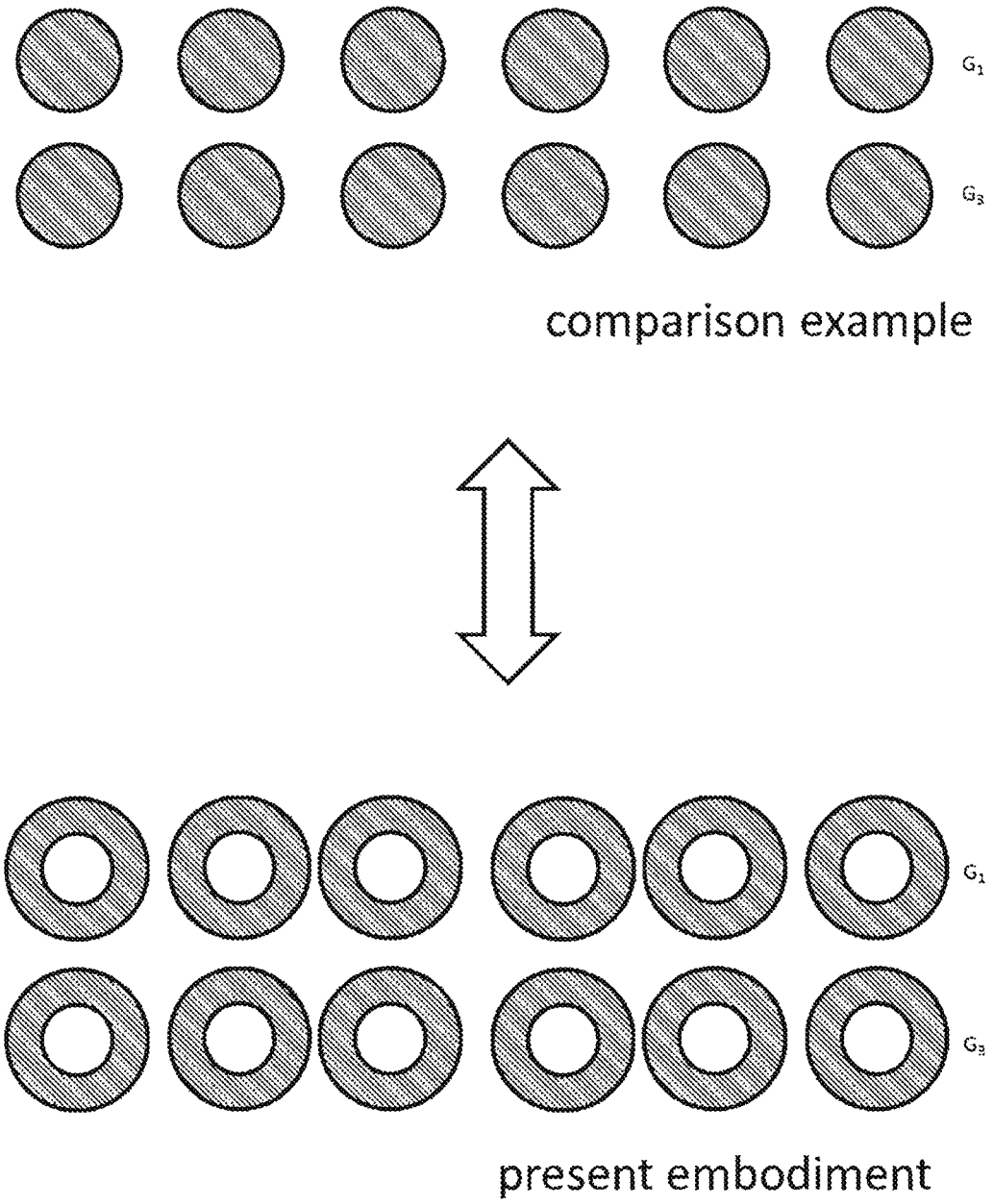
FIG. 5 is a conceptual diagram illustrating a difference between the double woven gauze fabric according to the second embodiment and a double woven gauze fabric of a comparison example.

FIG. 5 is a conceptual diagram illustrating a difference between the double woven gauze fabric according to the second embodiment and a fabric of the comparison example.

Table 3 shows a difference between a structure of the comparison example 3 and a structure of the example 3 of the present embodiment. Weight (g) per yarn of 100 m is also shown in Table 3. Sum of the two layers is set to be an index of weight.

TABLE 3

| comparison example 3 | weight (g) per 100 m | | second embodiment example 3 | weight (g) per 100 m |
|---|---|---|---|---|
| G1 yarn count of 40 ordinary yarn | 1.48 | ← | G1 yarn count of 30 hollow yarn | 1.57 |
| G3 yarn count of 40 ordinary yarn | 1.48 | → | G3 yarn count of 30 hollow yarn | 1.57 |
| sum of two layers | 2.96 | | sum of two layers | 3.14 |

The comparison example 3 is a double woven gauze fabric composed of two layers of gauze fabrics that are laminated together, each layer being formed of an ordinary yarn having a yarn count of 40. An index of weight is 2.96 g.

In the example 3, the surface layer $G_1$ and the back layer $G_3$ are formed of a hollow yarn having a yarn count of 30. An ordinary yarn having a yarn count of 30 has weight of 1.97 g per 100 m, whereas a hollow yarn having a yarn count of 30 has weight of 1.57 g per 100 m. That is, a hollow yarn is 20% lighter than the ordinary yarn. An index of weight is 3.14 g.

More specifically, the yarn of the example 3 is almost the same weight as (slightly heavier than) that of the comparison example 3. By making a comparison between the comparison example 3 and the example 3, effects of the present embodiment will be studied.

The surface layer $G_1$ and the back layer $G_3$ are formed of an ordinary yarn having a yarn count of 40 in the comparison example 3, whereas the surface layer $G_1$ and the back layer $G_3$ are formed of a hollow yarn having a yarn count of 30 in the example 3.

Since a yarn having a yarn count of 30 is thicker than a yarn having a yarn count of 40 (the former has about 15% larger diameter than the latter), the fabric of the example 3 shows more bulkiness. As a result thereof, more air can be retained, and heat-retaining property is improved in the example 3. Further, a hollow yarn retains air in its inside. This also contributes to enhancement of heat-retaining property in the example 3.

A yarn having a yarn count of 30 is thicker than a yarn having a yarn count of 40. If a yarn density is the same, a gap between yarns becomes narrower in the example 3. Further, the cloth of the example 3 is thicker than the cloth of the comparison example 3. As a result thereof, transparency preventing property improves.

Figure 6:
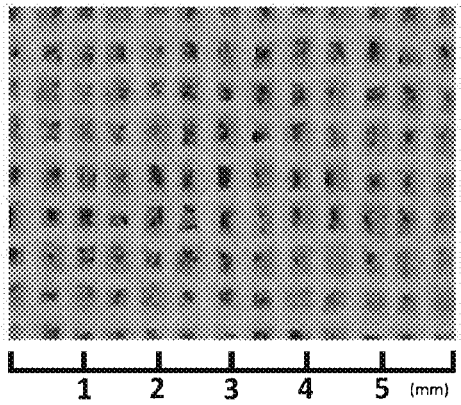
FIG. 6 includes enlarged pictures showing a difference in transparency preventing property between the double woven gauze fabric according to the second embodiment and a double woven gauze fabric of a comparison example.
Figure 6:
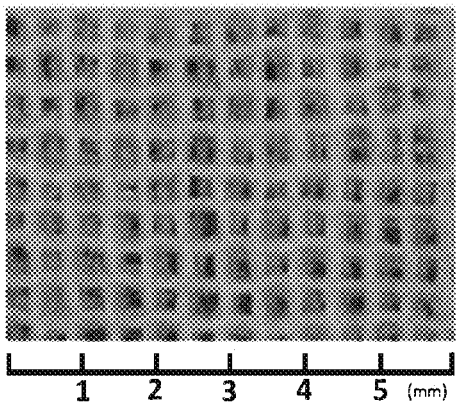

FIG. 6 is an enlarged view of the double woven gauze fabrics of the example 3(FIG. 6A) and the comparison example 3 (FIG. 6B) illustrating a difference of transparency preventing property therebetween. The cloth of the comparison example 3 is easy to see-through, and thus, when it is used for clothes, the cloth is colored in a dark color in order to compensate for the lack of transparency preventing property. To the contrary, since the cloth of the example 3 has the improved transparency preventing property, freedom can be obtained in a color selection.

A hollow yarn having a yarn count of 30 has weight equivalent to (slightly heavier than) an ordinary yarn having a yarn count of 40. This allows the woven gauze fabric of the example 3 to be about the same weight as (to be slightly heavier than) the woven gauze fabric of the comparison example 3.

Further, a hollow yarn is excellent in flexibility and softness, as compared to an ordinary yarn. This produces a soft touch feeling. Further, a hollow yarn is excellent in water absorbency property and drying property. Still further, a contact area that contacts skin increases because a hollow yarn having a yarn count of 30 is thicker than an ordinary yarn having a yarn count of 40. This produces a soft touch feeling.

The cloth of the example 3 that is thicker than the cloth of the comparison example 3 ensures also easy sewing.

Since a gap between yarns of the fabric of the example 3 was narrower than a gap between yarns of the fabric of the comparison example 3, there was a concern of degradation of breathability. However, as a result of a performance test, degradation of breathability was only at an ignorable level.

The woven gauze fabric naturally has a notable breathability, so that the woven gauze fabric is hardly influenced by the degradation of breathability. More specifically, the fabric of the example 3 has n breathability equivalent to breathability of the fabric of the comparison example 3.

As described above, the fabric of the example 3 is excellent in balance between breathability and heat-retaining property, transparency preventing property, good touch feeling (softness), and easy sewing property, as compared to the fabric of the comparison example 3 that has about the same weight as the fabric of the example 3.

Table 4 shows a difference between a structure of a fabric of a comparison example 4 and a structure of a fabric of an example 4 of the present embodiment. Table 4 shows also weight (g) of yarn per 100 m. Further, sum of weights of two layers is shown as an index.

TABLE 4

| comparison example 4 | weight (g) per 100 m | | second embodiment example 4 | weight (g) per 100 m |
|---|---|---|---|---|
| G1 yarn count of 50 ordinary yarn | 1.18 | ← | G1 yarn count of 40 hollow yarn | 1.18 |
| G3 yarn count of 50 ordinary yarn | 1.18 | → | G3 yarn count of 40 hollow yarn | 1.18 |
| sum of two layers | 2.36 | | sum of two layers | 2.36 |

The comparison example 4 is a double woven gauze fabric composed of two layers of gauze fabrics that are laminated together, the layers being formed of an ordinary yarn having a yarn count of 50. An index of weight is 2.36 g.

In the example 4, the surface layer $G_1$ and the back layer $G_3$ are formed of a hollow yarn having a yarn count of 40. An ordinary yarn having a yarn count of 40 has weight per 100 m of 1.48 g, whereas a hollow yarn having a yarn count of 40 has weight per 100 m of 1.18 g. That is, weight of a hollow yarn having a yarn count of 40 is 20% lighter than weight of an ordinary yarn having a yarn count of 40. An index of weight is 2.36 g.

In other words, the fabric of example 4 has about the same weight as the fabric of the comparison example 4. By making a comparison between the comparison example 4 and the example 4, effects of the present embodiment will be studied below.

The surface layer $G_1$ and the back layer $G_3$ are formed of an ordinary yarn having a yarn count of 50 in the comparison example 4, whereas the surface layer $G_1$ and the back layer $G_3$ are formed of a hollow yarn having a yarn count of 40 in the example 4.

A yarn having a yarn count of 40 is thicker than a yarn having a yarn count of 50 (the former has about 11% larger diameter than the latter). This allows the fabric of the example 4 to show more bulkiness. As a result thereof, more air can be retained, and thus heat-retaining property improves in the example 4. Further, a hollow yarn retains air in its inside. This also ensures improvement of heat-retaining property in the example 4.

A yarn having a yarn count of 40 is thicker than a yarn having a yarn count of 50. If a yarn density is the same, a gap between yarns is narrower in the example 4. Further, a cloth of the example 4 is thicker than that of the comparison example 4. As a result thereof transparency preventing property improves in the example 4.

In the comparison example 4, it is sometimes difficult to apply the cloth to clothes due to its transparency. However, in the example 4, transparency preventing property of the cloth is improved and, thus, applicability of the cloth to clothes is improved.

A hollow yarn having a yarn count of 40 has about the same weight as an ordinary yarn having a yarn count of 50, This allows the fabric of the example 4 to have about the same weight as the fabric of the comparison example 4.

Further, a hollow yarn is excellent in flexibility and pliability, as compared to an ordinary yarn. This can produce a soft touch feeling. A hollow yarn is also excellent in water absorbency property and drying property. Still further, since a yarn having a yarn count of 40 is thicker than a yarn having a yarn count of 50, a contact area that contacts skin increases. This produces more soft touch feeling.

In the example 4, easy sewing is achieved since the cloth is thick, as compared to the comparison example 4.

In the example 4, there was a concern of degradation of breathability since a gap between yarns was narrower than that of the comparison example 4. However, as a result of a performance test, the degradation of breathability was at an ignorable level. Since a woven gauze fabric naturally has notable breathability, it is hardly influenced by the narrowed gap between yarns. That is, the fabric of the example 4 has breathability equivalent to that of the fabric of the comparison example 4.

As described above, the fabric of the example 4 is excellent in balance between breathability and heat-retaining property, transparency preventing property, good touch feeling (softness), and easy sewing property, as compared to the fabric of the comparison example 4 that has almost the same weight as the fabric of the example 4.

In the example 3, the surface layer $G_3$ and the back layer $G_3$ are formed of a hollow yarn having a yarn count of 30. In the example 4, the surface layer $G_1$ and the back layer $G_3$ are formed of hollow yarns having a yarn count of 40. Meanwhile, use of a yarn having a yarn count thicker than a yarn count of 30 adversely effects on the gauze fabric, resulting in loosing characteristics of gauze fabric. In a double-layered gauze fabric that is composed of layers formed of a yarn having a yarn count finer than a yarn count of 50, it is sometimes difficult to apply such double-layered gauze fabric to clothes and bedding. Further, when taking practicality into consideration, it is preferred to use a yarn having a yarn count thicker than a yarn count of 40.

Meanwhile, when a comparison is made between the comparison example 3 and the example 4, bulkiness is equivalent, thus, a similar effect can be produced, and further lightness can be achieved in the example 4.

<Application to Clothes and Bedding>

As described above, the woven gauze fabrics according to the first embodiment and the second embodiment are excellent in balance between breathability and heat-retaining property, transparency preventing property, good touch feeling (softness), and easy sewing, as compared to the fabrics of the comparison examples that have almost the same weight as weight of the woven gauze fabrics according to the first embodiment and the second embodiment.

As a result thereof, the woven gauze fabrics according to the first embodiment and the second embodiment are suitable as a cloth for clothes (gowns, pajamas, shirts, pants, articles for infants, etc.) and bedding (sheets, blankets, pillow covers, etc.).

For example, breathability works during hot season in summer, and heat-retaining property works during cool (chilly) season in winter. This brings consumers a cool feeling in summer and a warm feeling in winter.

When the woven gauze fabrics according to the first embodiment and the second embodiment are used as pajamas or sheets, gaps in a hollow yarn absorb night-sweat, and excessive body temperature is dissipated owing to breathability of the woven gauze fabrics, while asleep. When a temperature lowers at dawn, heat-retaining property works. In sum, the woven gauze fabrics according to the first embodiment and the second embodiment are capable of providing comfortability all the time while asleep.

<Study About Difference from Non-Twisted Yarn>

Meanwhile, a non-twisted yarn is a yarn formed such that a twisted yarn is reversely twisted to place the yarn in a non-twisted state. This yarn puffs softly and retains much air between fibers. Therefore, instead of using a hollow yarn for the surface layer $G_1$ and the back layer $G_3$ as in a case of the present invention, it may be possible to produce effects similar to the effects of the present invention, e.g., heat-retaining property and transparency preventing property, even with the use of a non-twisted yarn. However, the fabric of the present application is more advantageous in the following points.

A non-twisted yarn has loose bundling among the fibers, and thus there is a concern of fluff come out. Specifically, with the use of a fine yarn that is normally used in a woven gauze fabric, this concern becomes remarkable.

Since clothes make a continuous close contact with skin, if fluff come out occurs, fluff adheres to skin. As a result thereof, the fluff come out becomes more notable. Further, such fluff come out may provide the consumers an uncomfortable feeling. Still further, progress of fluff come out adversely effects on the fabric, resulting in loosing effects produced by a non-twisted yarn.

In a case where the fabric is used for pants, etc., every time a consumer sits down on a chair, the fluff come out may occur due to a friction force. Further, a dairy action may cause a friction force to occur around the consumer's neck of the shirt.

To the contrary, use of a hollow yarn as in a case of the present invention will eliminate the concern of fluff come out. A hollow yarn is excellent in durability.

A non-twisted yarn is characterized in napping (fluff up), and thus heat transfer hardly occurs. As a result thereof, warm/cold feeling in contact is small in a non-twisted yarn, as compared to a gauze fabric woven by a twisted yarn. The performance works suitably during a cool (chilly) season; however, in a season that a temperature is high to be sweaty, the consumers may feel swelter.

A surface of a hollow yarn used in the present invention has the same structure as that of a twisted yarn. Therefore, consumers shall not feel swelter.

<Others>

Descriptions of more specific embodiments were made hereinabove. The present invention is not limited only to the above described embodiments. Various modifications and applications that will not largely impair characteristics of the present invention are also encompassed within the scope of the present invention.

Specifically, in clothes, heat-retaining property, breathability, etc., largely changes depending on shapes (designs) of clothes. However, in the specification of the present application, various performances of the woven gauze fabric as cloth are studied without considering influence of the shapes of clothes.

REFERENCE CHARACTER LIST $G_1$ first layer (surface layer)
$G_2$ second layer (middle layer)
$G_3$ third layer (back layer)
1, 2, 3, 4, 5, 6 warp yarn
A, B, C, D, E, F weft yarn

The invention claimed is:

1. A woven gauze fabric comprising:

a surface layer and a back layer;

wherein the surface layer and the back layer are indirectly joined together, wherein the surface layer is formed of warp yarns and weft yarns which are composed of a first hollow cotton yarn having a yarn count of 30-50 (both inclusive), the surface layer having a flat surface, wherein the back layer is formed of warp yarns and weft yarns which are composed of a second hollow cotton yarn having a yarn count of 30-50 (both inclusive), the back layer having a flat surface, wherein the first hollow yarn of the surface layer and the second hollow yarn of the back layer have a yarn count of 40-50 (both inclusive), wherein at least one middle layer is interposed between the surface layer and the back layer, the middle layer is formed of warp yarns and weft yarns, and wherein the at least one middle layer of a plurality of middle layers is formed of a single non-hollow yarn having a fine count that is finer than the first hollow yarn of the surface layer and the second hollow yarn of the back layer, wherein surfaces of the layers are separated and substantially spaced apart from each other, and wherein the surface layer and the back layer are indirectly joined together comprising that at least one warp yarn of the middle layer entwines at least one weft yarn of the surface layer, and at least one warp yarn of the middle layer entwines at least one weft yarn of the back layer, each layer is configured to move slightly between each other.

2. A woven gauze fabric comprising:

a surface layer and a back layer;

wherein the surface layer and the back layer are indirectly joined together, wherein the surface layer is formed of warp yarns and weft yarns which are composed of a first hollow cotton yarn having a yarn count of 30-50 (both inclusive), the surface layer having a flat surface, wherein the back layer is formed of warp yarns and weft yarns which are composed of a second hollow cotton yarn having a yarn count of 30-50 (both inclusive), the back layer having a flat surface, wherein the first hollow yarn of the surface layer and the second hollow yarn of the back layer have a yarn count of 40-50 (both inclusive), wherein at least one middle layer is interposed between the surface layer and the back layer, the middle layer is formed of warp yarns and weft yarns, and wherein the at least one middle layer of a plurality of middle layers is formed of a double non-hollow yarn having a fine count that is finer than the first hollow yarn of the surface layer and the second hollow yarn of the back layer, wherein surfaces of the layers are separated and at least partially spaced apart from each other, and wherein the surface layer and the back layer are indirectly joined together comprising that at least one warp yarn of the middle layer entwines at least one weft yarn of the surface layer, and at least one warp yarn of the middle layer entwines at least one weft yarn of the back layer, each layer is configured to move slightly between each other.

3. The woven gauze fabric according to claim 2, wherein the woven gauze fabric is a double gauze comprising the surface layer and the back layer, and wherein the first hollow yarn if the surface layer and the second hollow yarn of the back layer have a yarn count of 30-40 (both inclusive).

4. The woven gauze fabric according to claim 2, wherein the woven gauze fabric comprises a woven gauze fabric garment.

5. Clothes formed of the woven gauze fabric according to claim 2.

6. Bedding formed of the woven gauze fabric according to claim 2.

7. The woven gauze fabric according to claim 2, wherein the first hollow yarn and the second hollow yarn are each air filled.

8. The woven gauze fabric according to claim 2, wherein the surface layer and the back layer are indirectly joined together at different points through the middle layer.

9. The woven gauze fabric according to claim 1, wherein the woven gauze fabric is a double gauze comprising the surface layer and the back layer, and wherein the first hollow yarn of the surface layer and the second hollow yarn of the back layer have a yarn count of 30-40 (both inclusive).

10. The woven gauze fabric according to claim 1, wherein the woven gauze fabric comprises a woven gauze fabric for garment.

11. Clothes formed of the woven gauze fabric according to claim 1.

12. Bedding formed of the woven gauze fabric according to claim 1.

13. The woven gauze fabric according to claim 1, wherein the first hollow yarn and the second hollow yarn are each air filled.

14. The woven gauze fabric according to claim 1, wherein the surface layer and the back layer are indirectly joined together at different points through the middle layer.

15. A woven gauze fabric comprising:

a surface layer and a back layer;

wherein the surface layer and the back layer are indirectly joined together, wherein the surface layer is formed of warp yarns and weft yarns which are composed of a first hollow cotton yarn having a yarn count of 30-50 (both inclusive), the surface layer having a flat surface, wherein the back layer is formed of warp yarns and weft yarns which are composed of a second hollow cotton yarn having a yarn count of 30-50 (both inclusive), the back layer having a flat surface, wherein the first hollow yarn of the surface layer and the second hollow yarn of the back layer have a yarn count of 40-50 (both inclusive), wherein at least one middle layer is interposed between the surface layer and the back layer, the middle layer is formed of warp yarns and weft yarns, and wherein the at least one middle layer of a plurality of middle layers is formed of a single non-hollow yarn having a fine count that is finer than the first hollow yarn of the surface layer and the second hollow yarn of the back layer, wherein surfaces of the layers are separated and free from contact in substantial portion from each other, and wherein the surface layer and the back layer are indirectly joined together comprising that at least one warp yarn of the middle layer entwines at least one weft yarn of the surface layer, and at least one warp yarn of the middle layer entwines at least one weft yarn of the back layer, each layer is configured to move slightly between each other.

* * * * *